US005497720A

United States Patent [19]

Kawasaki

[11] Patent Number: 5,497,720

[45] Date of Patent: Mar. 12, 1996

[54] DEVICE FOR GUIDING A COVER MEMBER TO A SEWING MACHINE

[75] Inventor: Kiyoshi Kawasaki, Akishima, Japan

[73] Assignee: Tachi-S Co., Ltd., Tokyo, Japan

[21] Appl. No.: 218,138

[22] Filed: Mar. 25, 1994

[51] Int. Cl.[6] ..... D05B 35/10

[52] U.S. Cl. ..... 112/153; 112/306; 112/308; 226/17

[58] Field of Search ..... 112/308, 309, 112/306, 318, 322, 320, 153, 121.11, 121.12; 226/17, 15, 21

[56] References Cited

U.S. PATENT DOCUMENTS 3,368,726 2/1968 Funk et al. ..... 226/17
3,889,614 6/1975 Nicolay et al. ..... 112/318 X
5,020,460 6/1991 Babson et al. ..... 112/306 X

*Primary Examiner*—Peter Nerbun
*Attorney, Agent, or Firm*—Oldham & Oldham Co.

[57] ABSTRACT

A device for guiding a cover member to a sewing machine, which basically includes a control arm supported pivotally on the table of sewing machine, a guide roller assembly mounted rotatably to the control arm, and a link assembly supported pivotally on the sewing machine table. The guide roller assembly, which is to retain the cover member therein, may be adjustably displaced in conjuction with the link assembly by a control drive mechanism which is operatively connected to the control arm. With detection of one curved end of the cover member, this guiding device permits even a multilayer-type cover member to be sewn, smoothly and precisely, along its one curved end.

20 Claims, 4 Drawing Sheets

DEVICE FOR GUIDING A COVER MEMBER TO A SEWING MACHINE

BACKGROUND OF INVENTION

1. Field of the Invention

The present invention relates to a device for guiding a cloth-like member or cover member to a sewing machine adapted to sew a trim cover assembly for automotive seat. More particularly, the invention is directed to a device for guiding to such sewing machine a three-layer-lamination-type trim cover assembly having a curved or wavy edge.

2. Description of Prior Art

In a commonly practiced process for producing a trim cover assembly for automotive seat, several separate pieces of base cover members are sewn together at and along their respective mating ends by use of a sewing machine in order to form a trim cover assembly. Generally, for instance, the first step involves providing two separate base cover members, one of which forms a central seating cover section corresponding to a central seating area of the seat, and another of which forms a peripheral side cover section corresponding to the lateral side wall of the seat surrounding the central seating area of the same. Then, in the second step, both ends of those two base cover members are sewn together by a sewing machine to create a trim cover assembly which is to be affixed over a padding member having an outer shape of automotive seat.

The foregoing sewing processes, in some cases, utilize two separate pieces of three-layer-lamination-type base cover members, each or one of which has a curved or wavy end and comprising the following three layers: a top cover member, a wadding (made of a slab urethane foam material) and a wadding cover (a non-woven cloth) which are laminated in this order. In that particular case, it has been difficult to sew such two base cover members together along their respective ends. That is, conducting a manual sewing thereto requires a high skill on the operator's part, which frequently results in producing undesired different sizes or shapes of trim cover assembly, depending on the technical artisan ability of individual operators, or alternatively, an automated sewing arrangement may be contemplated thereon, but any technical solution in the automated sewing mechanism has not been found to precisely and easily sew together those two three-layer cover members along their curved or wavy ends.

Of course, with regard to the automated sewing arrangement, there has been known several automated sewing machines and systems, such as the ones disclosed from the U.S. Pat. Nos. 4,899,674, 4,899,675 and 4,928,609, and the Japanese Patent Laid-Open Pub. No. 58-188492. All of them are based on such construction that a base plate is provided on a table of sewing machine, the base plate having two or more guide grooves formed therein, a plurality of rollers are slidably inserted in the guide grooves and a guide means (e.g. a small movable plate, a movable arm or a stationary guide member) is fixed to the rollers, whereby the curved end of one cover member is sewn to the likewise shaped or rectilinear end of another cover member, with the guiding aid of such guide means being moved along the guide grooves via the rollers, which guide grooves define a given track that ought to be followed by the guide means per se in order to cause a curved or rectilinear end of one cover member to be sewn to and along a curved, wavy end of another cover member.

However, in practical case, when the above-stated three-layer base cover member is applied to such prior-art automated sewing machines, a substantive amount of feeding force is required in the sewing machine itself to feed that thick element, which in turn encounters an non-smooth sliding movement of the guide rollers along the guide grooves. As a result of this, an ordinary sewing machine can not work in this particular case, or rather, this is especially true when sewing a rectilinear end of one cover member along an acutely curved or very irregularly wavy end of another cover member, because it requires preparing many different base plates with various shapes of guide grooves, or it will inevitably bring about a mutual interference of the guide rollers in the guide grooves due to the acutely curved end of cover member. Moreover, this makes it difficult to sew a linearly extending bead together with and along that curved end of cover element for decorative purpose. Also, in terms of setting a precise sewing position for both cover members, the prior arts have been with such further problem that even a slight dislocation of the cover members with respect to the base plate, or a slight difference in size between the two cover members, will differ a sewing point from a fixed sewing position of the sewing machine, hence making it impossible to maintain a constant fixed sewing position in the actual sewing process which may often involve such slight dislocation or slight size difference problem.

SUMMARY OF THE INVENTION

In view of the above-stated drawbacks, it is therefore a primary purpose of the present invention to provide an improved device for guiding a cover member to a sewing machine, which enables subjecting any curved or wavy end portion of trim cover assembly to a precise and smooth sewing.

In order to attain such purpose, in accordance with the present invention, there is basically provided a device for guiding a cover member to a sewing machine, comprising:

- a pair of upper and lower guide roller means for retaining the cover member therebetween, while allowing the same to be fed toward the sewing machine, those upper and lower guide roller means being disposed in the vicinity of a sewing portion of the sewing machine;
- a pair of upper and lower control arm means, each having one end connected operatively with the two upper and lower guide roller means and another end connected operatively with a control drive mechanism;
- such pair of upper and lower control arm means being so pivotally rotatable that the one end thereof may be rotated, through operation of the control drive mechanism, relative to a pivot point, to thereby cause rotative displacement of the upper and lower guide roller means in reference to a direction wherein the cover member is sewn by the sewing machine; and
- a link means including a first link element having one end fixed to the foregoing upper and lower guide roller means and a second link element having one base end portion pivotally connected to a table of the sewing machine and another free end portion connected pivotally to another end of the first link element.

Accordingly, with the upper and lower control arm means and the link means cooperating with each other to allow the rotative displacement of the upper and lower roller means to effected through the operation of the control drive mechanism, the cover member is guided by the upper and lower roller means and fed towards the sewing portion of the sewing machine.

Preferably, the above-mentioned pair of upper and lower guide roller means may be connected rotatably to the foregoing one end of the upper and lower control arm means, with the upper and lower control arm means being pivotally supported, generally at the center thereof, by a support means upon the table of sewing machine, and the control drive mechanism may include a sensor means which is so disposed in the proximity of said sewing machine as to detect one curved end of said cover member and a dislocation of the same from a reference line set by the sensor means, i.e. a tangential line touching on a curvature in said curved end of said cover member. Further, the base end portion of the second link element is pivotally supported by a support means disposed between the sensor means and the support means of upper and lower control arm means. Thus, responsive to such detection of the sensor means, the control drive mechanism causes the upper and lower control arm means to be rotated generally about the center thereof, thereby causing the upper and lower guide roller means to be displaced rotatively relative to that center together with the first and second link elements, so as to correct a position of the cover member whereby the cover member is precisely sewn along the curved end of said cover member.

With this basic structure, it is possible to sew a three-layer-lamination-type trim cover assembly along the curved or wavy end thereof.

Other specific structural features and advantages of the present invention will become apparent from reading of the description hereinafter, with reference to the drawings.

DETAILED DESCRIPTION OF PREFERRED EMBODIMENT OF THE INVENTION

Figure 1:
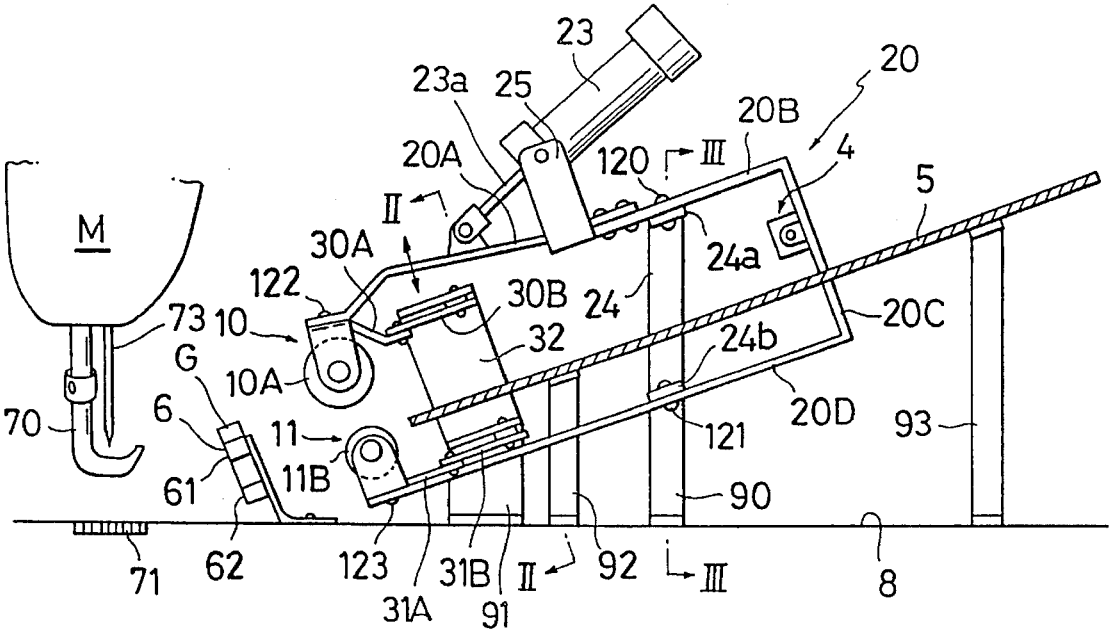
FIG. 1 is a side view of a device for guiding a cover member to a sewing machine in accordance with the present invention.

Referring to FIGS. 1 thorough 9, there is illustrated one preferred embodiment of the present invention.

Figure 2:
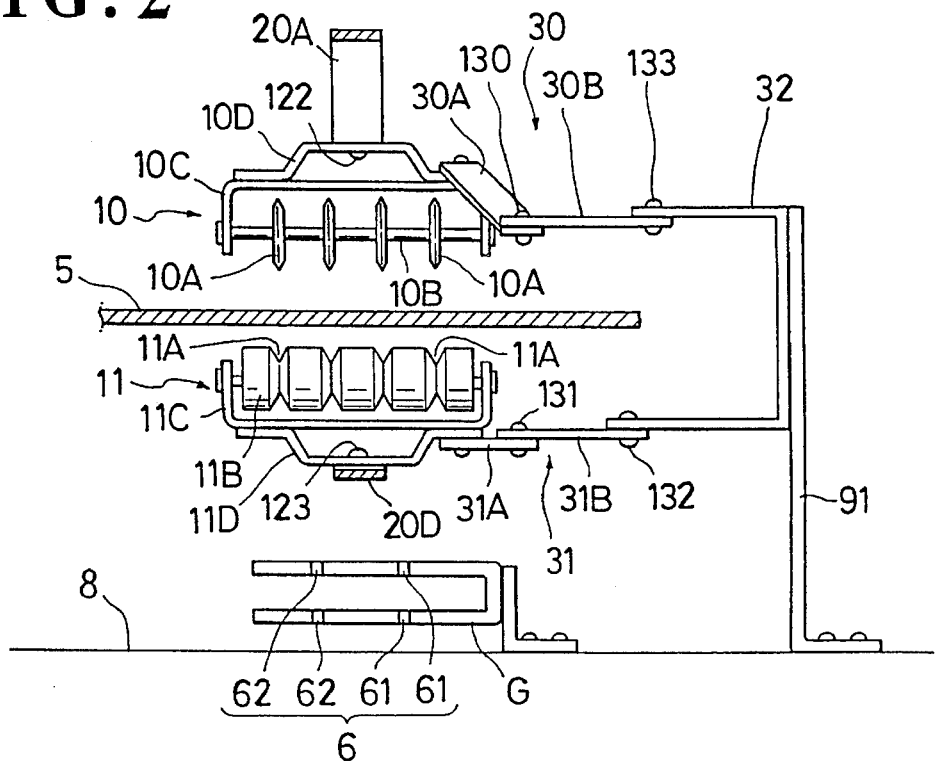
FIG. 2 is a sectional view taken along the line II—II in FIG. 1.

FIGS. 1 and 2 show a general structure of a guide device for guiding a base trim cover assembly (F) (see FIG. 9) to a known ordinary sewing machine (M), in accordance with the present invention, which is arranged upon a sewing machine table (8). As shown, the guide device is located in the vicinity of the retainer (70), feeding member (71) and sewing needle (73) of the sewing machine (M).

Figure 4:
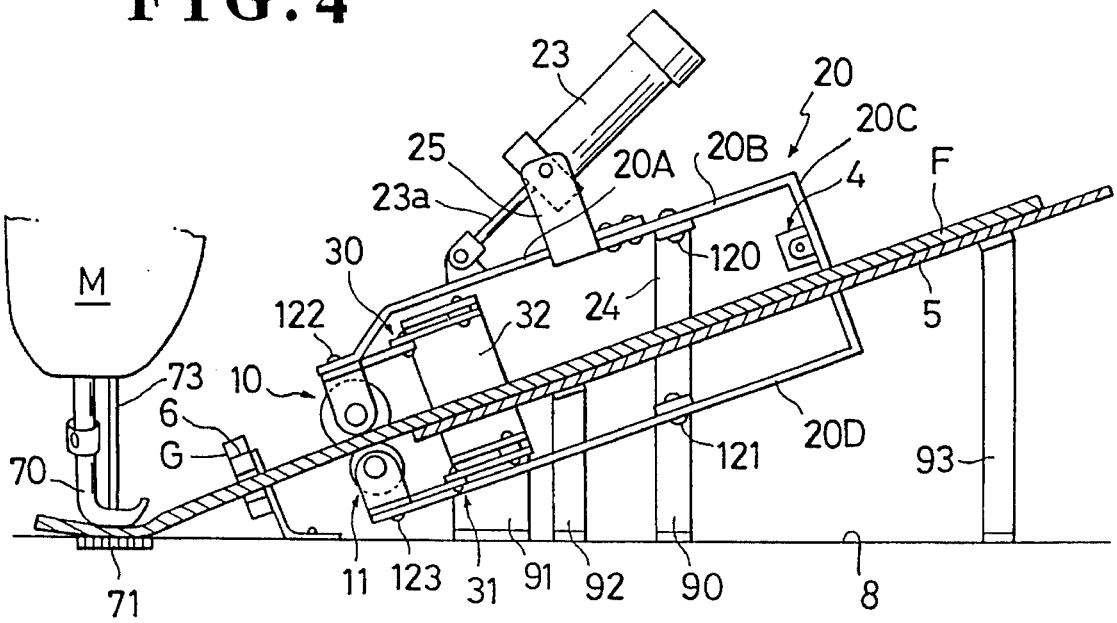
FIG. 4 is a side view the guiding device, showing a trim cover assembly to be guided by the device to a sewing machine.

Basically, the guide device is comprised of a base plate (5) on which the base trim cover assembly (F) is to be placed, a guide roller assembly (10, 11), a control arm (20), a link assembly (30, 31), a sensor (6) and a drive control mechanism (4) (see FIG. 4).

As shown in FIG. 1, the base plate (5) is supported in a downwardly inclined state upon the table (8) by means of two support members (92)(93), so that the base trim cover assembly (F) may be easily, slidingly guided towards the sewing needle (73) of the sewing machine (M). At the same inclination angle with that of such base plate (5), the control arm (20) is supported via a support pillar (90) upon the table (8).

Figure 5:
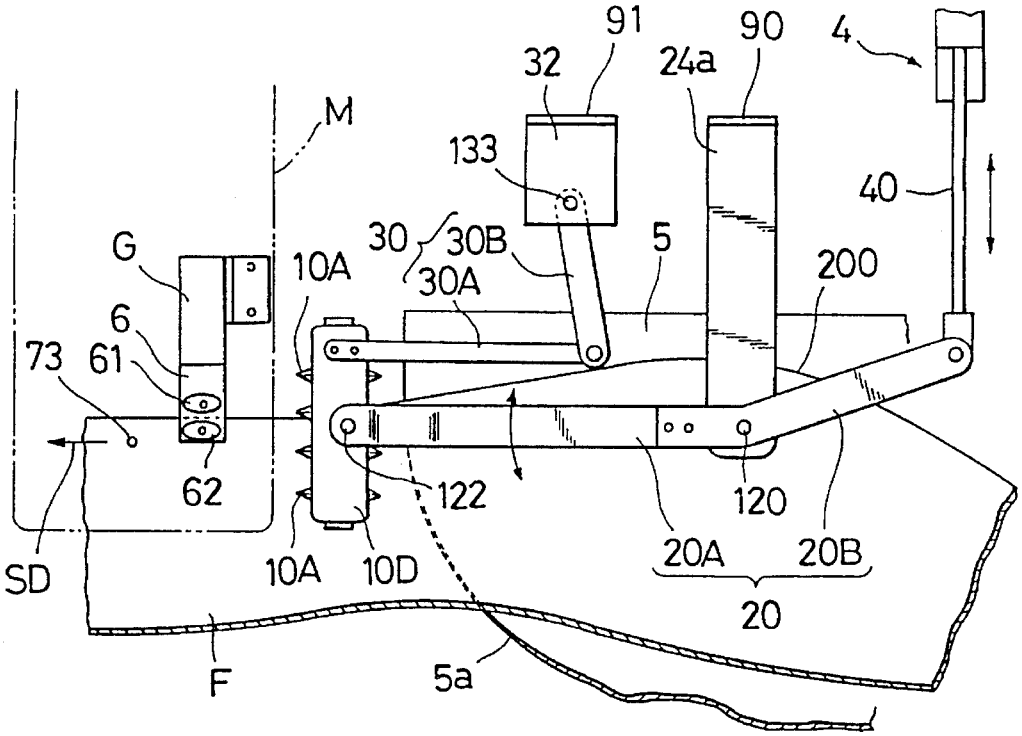
FIG. 5 is a partly broken, schematic plan view of the guiding device.

The base plate (5) is generally of such a shape as shown in FIG. 5, having a arcuate or curved end portion (5*a*) extending inwardly of and along a circle of track along which the forward free end of control arm (20) is rotated relative to a center of rotation at (120), thereby avoiding interference with rotation of the roller assembly (10,11) provided at that control arm forward end.

The control arm (20) comprises a rigid arm body portion (20B, 20C, 20D) and a resiliently bendable arm portion (20A). The rigid arm body portion is formed from a rigid metallic material, comprising an upper arm section (20B), a lower arm section (20D), and a vertically extending rearward arm section (20C) defined therebetween. Those arm sections are all formed integrally together, assuming a generally ⊐-shaped configuration as viewed, in elevation, from FIG. 1. The resiliently bendable arm portion (20A) is formed from a relatively elastic suitable material, such as a leaf spring or the like, and fixedly connected at its rearward end to the upper arm section (20B).

Figure 3:
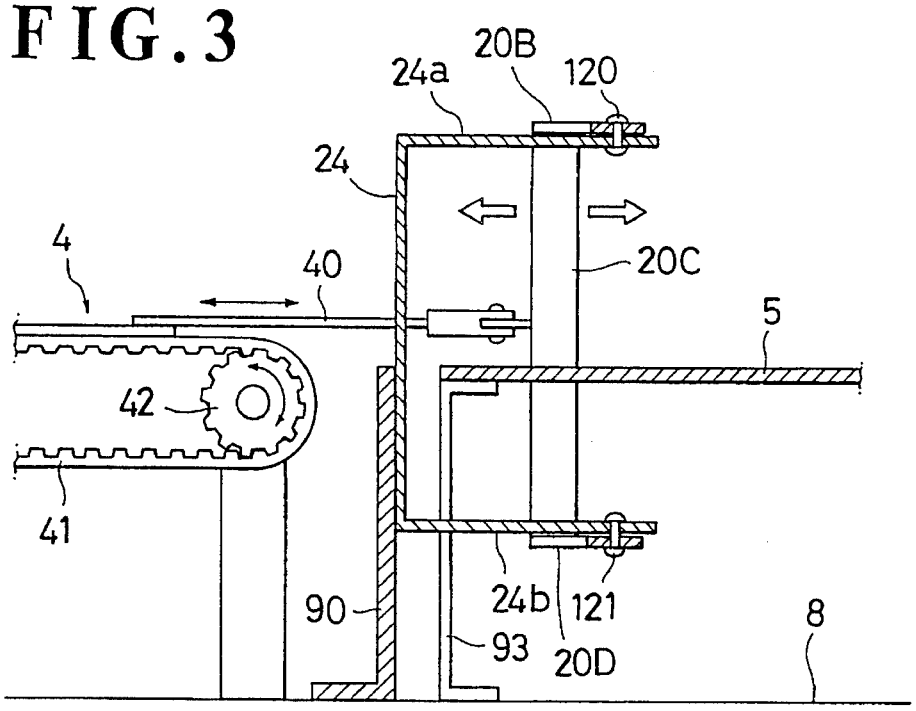
FIG. 3 is a sectional view taken along the line III—III in FIG. 1.

The above-constructed control arm (20) is rotatably supported by a ⊏-shaped support bracket (24) fixed to a support pillar (90) erected fast on the table (8), as best seen in FIG. 3, the support bracket (24) having a pair of spaced-apart upper and lower horizontally extending bracket portions (24*a*)(24*b*), each projecting above and below the base plate (5), respectively. Namely, the upper arm section (20B) of the arm (20) is connected rotatably via a pivot (120) to the upper bracket portion (24*a*) of support bracket (24), while the lower arm section (20D) of the arm (20) is connected rotatably via a pivot (121) to the lower bracket portion (24*b*) of the same. Both upper and lower pivots (120)(121) are defined concentrically, and thus, as understandable from the arrow direction in FIG. 5, both upper and lower arm protions (20A)(20D) are simultaneously rotatable on the opposite sides of the base plate (5) in relation to those two concentric pivots (120)(121) froming the center of rotation.

As shown in FIG. 3, the drive control mechanism (4) is operatively connected via an actuator rod (40) to the rearward vertical arm section (20C) of the arm (20). The drive control mechanism (4) includes an endless belt (41) and a driving wheel (42) engaged with the belt (41). The actuator rod (40) is fixed at its base end part upon the endless belt (41). Rotation of the driving wheel (42), which is of course driven by a motor (not shown), causes the belt (41) to be moved in a normal or reverse direction, which in turn causes the actuator rod (40) to be moved forwardly or backwardly, as indicated by the arrow in FIG. 3, in a direction orthogonal to a sewing direction of the sewing machine (M) (see the arrow (SD) in FIG. 5). Although not shown, the drive mechanism (4) is provided with a computerized control area including a central processing unit (microcomputer), a drive circuit and other required electric elements, and workable according to a program preset in the central processing unit, so as to control the rotation of the wheel (42) and thus the resulting translation of the actuator rod (40) via the endless belt (41). Under such controlled fore-and-aft longitudinal motion of actuator rod (40), the rearward side of the arm (20) may be rotated clockwise or anticlockwise relative to the center of rotation at (120, 121), as in FIG. 5, to thereby orient the forward side of the arm (20) in a certain direction in reference to the sewing machine (M) or its sewing direction (SD), for a purpose to be explained later.

The formation and material of the arm (20) is not limited to this embodiment, but may be modified in any other proper manner insofar as it achieves the functions aimed by the present invention.

A hydraulic cylinder (23) is mounted to the upper arm section (20B) of control arm (20) via a bracket (25). The piston rod (23*a*) projected from the cylinder (23) is pivotally connected to the foregoing resiliently bendable arm portion (20A) of control arm (20), and thus, operation of the cylinder (23) causes vertical movement of the bendable arm portion (20A) with respect to the stationary lower arm section (20D), as indicated by the arrow in FIG. 1.

It is noted here that FIGS. 5 to 8 do not show such cylinder (23) in order to facilitate the understanding of motions of the control arm (20), but assume that the cylinder (23) is mounted on the arm (20) in all those figures, too.

Provided movably on the forward ends of the above-stated bendable arm portion (20A) and stationary lower arm section (20D), is the guide roller assembly which essentially consists of a pair of upper and lower roller elements (10)(11), each being shown to include a plurality of upper disc-like rollers (10A) and a lower cylindrical roller (11B), respectively. As best shown in FIG. 2, the upper disc-like rollers (10A) are rotatably journalled in the inverted-U-shaped cross-section of upper support portion (10C) which is in turn rotatably connected to the forward end of the bendable arm portion (20A). Otherwise stated, the support portion (10C) is pivotally connected via a connecting bracket (10D) to the forward end of bendable arm portion (20A), such as to be rotatable about a pivot (122), and the disc-like rollers (10A) are rotatably supported within the support portion (10C) by a shaft (10B). On the other hand, the lower cylindrical roller (11B) is likewise rotatably journalled in the U-shaped cross-section of lower support portion (11C). Namely, the lower support portion (11C) is pivotally connected via a connecting bracket (11D) to the forward end of stationary lower arm section (20D), such as to be rotatable about a pivot (123).

The lower cylindrical roller (11B) is formed with plural annular grooves (11A) on the peripheral surface thereof, each of those annular grooves (11*a*) being disposed in correspondence with the respective plural disc-like rollers (10A), as shown in FIG. 2, so that the downward movement of the upper bendable arm portion (20A) will bring the upper disc-like rollers (10A) into a meshed engagement with the lower annular grooves (11A), respectively.

Desirably, as can be seen from FIGS. 1 and 2, both upper and lower elements (10B, 10C, 10D, 122, 11C, 11D, and 123) should be formed from the same materials of same shapes and dimensions, for the sake of low costs. Also, preferably, the upper rollers (10A) may be formed from a metallic disc-like material and the lower roller (11B) be formed from a synthetic resin material.

The link assembly (30)(31) is, as seen in FIG. 1, arranged in a downwardly inclined state with respect to the table (8) at the same inclination angle with that of the base plate (5) and on the same longitudinal line with the control arm (20). It comprises an upper link member (30) and a lower link member (31). The upper link member (30) is composed of a base link section (30B) and a resiliently bendable link section (30A) whose rearward end is connected rotatably via a pivot (130) to the forward end of the base link section (30B), whereas likewise, the lower link member (31) is composed of a base link section (31B) and a rigid link section (31A) whose rearward end is connected rotatably via a pivot (131) to the forward end of the base link section (31B). Further, as illustrated, both free rearward ends of the two base link sections (30B)(31B) are connected rotatably via the respective two pivots (133)(132) to a support bracket (32). The forward free end of the upper bendable link section (30A) is fixed to the upper roller element (10), and also, the forward free end of the lower link section (31A) is fixed to the lower roller element (11), whereupon, since both upper and lower roller elements (10) (11) faces towards each other on the same line, both upper and lower link members (30)(31) extends generally in the same longitudinal direction in parallel with each other, except for the bendable link section (30A). Thus, as will be described later, both upper and lower link members (30) (31) are movable simultaneously above and below or on the opposite sides of the base plate (5) in an articulating way at the two pivots (130)(133) in synchronism with the rotation of the control arm (20). As can be seen from FIG. 5 in conjunction with FIG. 1, both forward link sections (30A and 31A) extend rearwardly from and at a right angle with the roller assembly (10, 11) and further so fixed to the respective connecting brackets (10D)(11D) of the same roller assembly that, when the control arm (20) is located in an initial position, as in FIG. 5, orienting toward the sewing machine (M) on the same line with the sewing direction (SD), the two link sections (30A)(31A) in question lie alongside and in parallel with the longitudinal axis of control arm (20). Yet further, the free ends of both forward link sections (30A, 31A) are restricted to movability with the rotatable roller assembly (10, 11), by being connected pivotally to the free ends of both rearward link sections (30B, 31B) which are rotatable along a predetermined circle whose center is fixed at the pivots (133, 132). Accordingly, it is appreciated that even with the rotation of the control arm (20) away from the initial position to another position shown in FIG. 6, such arrangement of link assembly effectively causes the roller assembly (10, 11) to rotate gradually and stably about their concentric pivots (122)(123) in a generally tangential direction with the circle along which the forward end of control arm (20) is rotated relative to the rotation center at (120, 121), hence avoiding undesired wobbling and unnecessary rotation of the roller assembly per se, and adding to a high precision effect in guiding the trim cover assembly (F) to the sewing machine (M).

Designation (91) denotes a support pillar supporting the support bracket (32).

Figure 7:
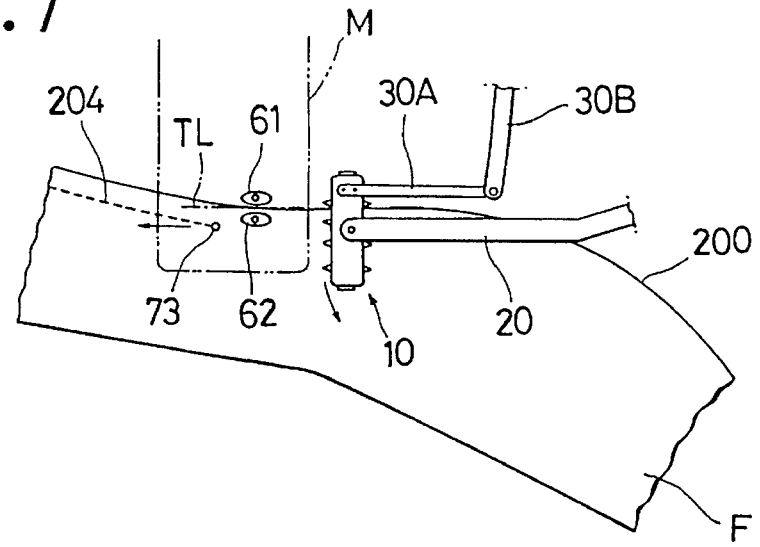
FIG. 7 is a schematic diagram which explanatorily shows a sewing process, using the guiding device.
Figure 8:
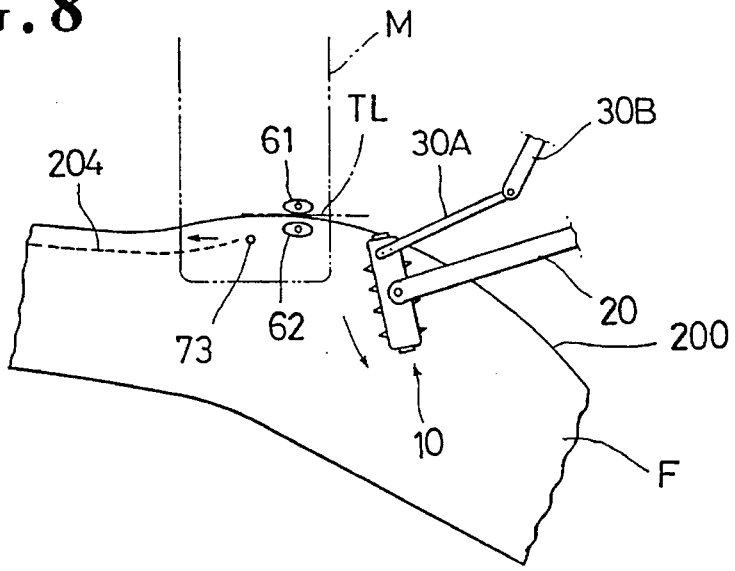
FIG. 8 is a schematic diagram which explanatorily shows a further sewing process continued from the sewing process in FIG. 7.
Figure 9:
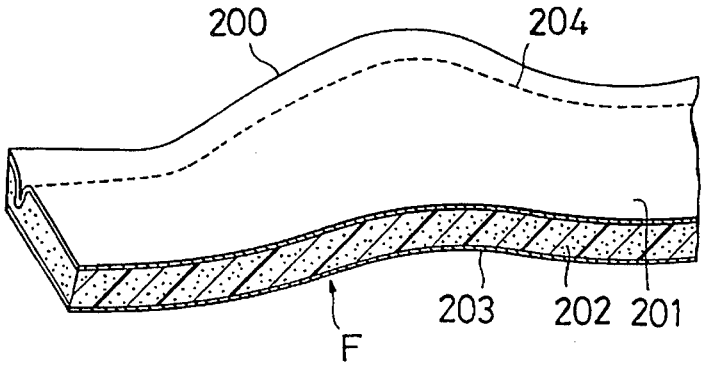
FIG. 9 is a partly broken, schematic perspective view of the trim cover assembly.

The sensor (6) is supported by a bracket (G) upon the table (8) and disposed in the proximity of the sewing needle (73). The bracket (G) is of a generally channel cross-section shape, as shown in FIG. 2, allowing the base trim cover assembly (F) to be passed therethrough. The sensor (6) comprises a pair of spaced-apart photosensors (61)(62) adapted to detect, therebetween, a curved or wavy end portion (see (200) in FIGS. 5 and 9) of the base trim cover assemlby (F) which is to be sewn, as to which position it is located and which direction it is oriented, in reference to the sewing needle (73) and its sewing direction (SD). Those sensors (61)(62) are electrically connected with the aforementioned drive control mechanism (4), though not shown, with such an arrangement that the sensors (61)(62) detect the curvature of curved end (200) of base trim cover assembly (F) and send a detection signal to the central processing unit (not shown) of the drive mechanism (4), which then causes an appropriate rotation of the arm (20) so as to swing and adjust the remaining non-sewn curved end portion of trim cover assembly (F) toward a proper position where the tangential line (see (TL) in FIGS. 7 and 8) touching on a presently sewing curved point in that particular non-sewn end portion is oriented in a direction parallel with the sewing direction (SD) of sewing machine (M). In this way, the sewing is controlled along the curvature of curved end (200) of trim cover assembly (F), leaving a seam (204) therealong, as indicated in FIGS. 8 and 9. Further explanation thereon will be made as below.

Now, a description will be given about the operation of the above-described guide device.

Firstly, in accordance with the present invention, a type of trim cover assembly of a great concern is the three-layer-lamination-type trim cover assembly, as stated earlier in the prior-art description, which is a typical one shown and designated by (F) in FIG. 9, having a curved or wavy end (200), with the following three layers laminated therein: a top cover member (201), a foam wadding or padding (202) and a wadding cover or back cloth (203) in this order.

Secondly, as shown in FIG. 1, prior to sewing operation by the sewing machine, the upper roller element (10) is kept in a raised position away from the lower roller element (11) by operating the cylinder (23).

Then, as shown in FIG. 4, this trim cover assembly (F) is placed on the base plate (5), while passing the same between the upper and lower roller elements (10)(11) and also passing it through the sensor (6), so that the forward end thereof projects between the retainer (70) and feeding member of sewing machine (M), and the curved end (200) thereof is set at a given position for sewing by the sewing machine (M). Thereafter, by operation of the cylinder (23), the upper roller element (10) is caused to be lowered toward the lower roller element (11) such as to sandwich and retain the trim cover assembly (F) by the plural disc-like rollers (10A) and cylindrical roller (11A). Under this condition, the trim cover assembly (F) is positively retained by the indirect meshed engagement of the disc-like rollers (10A) of upper roller element (10) with the respective annular grooves (11A) of lower roller element (11) via the layer of trim cover assembly (F).

Next, with operation of the sewing machine (M), the trim cover assembly (F) is fed automatically and subject to sewing. At the same time, the sensor (6) works to detect the end (200) of trim cover assembly (F). Referring now to FIGS. 7 and 8, when the curved area in that trim cover assembly end (200) reaches the sensor (6), the two photosensors (61)(62) immediately detect a slight dislocation of the end (200) as it intercepts a light beam of one of the photosensors (61)(62), and send a detection signal to the control drive mechanism (4), which also quickly causes forward movement of the actuator rod (40) to rotate the control arm (20) about the pivot (120, 121) anticlockwise as indicated by the arrow in FIG. 8. Under a programmed control of the drive mechanism (4), the control arm (20) is rotated to a proper angle in order that the remaining non-sewn area of trim cover assembly (F) is displaced along such anticlockwise rotation of control arm (20), in an attempt to correct the direction of trim cover assembly end (200) between the photosensors (61)(62), thereby adjusting the orientation of trim cover assembly (F) with respect to the sewing point at (73) such that the tangential line touching on the presently sewing curved point of trim cover assembly end (200) is kept in parallel with the sewing direction (SD) indicated by the horizontal arrows in both FIGS. 7 and 8. With this control, the sewing is precisely carried on along the curve or wavy end (200) of trim cover assembly (F), whereby there is obtained a trim cover assembly with the seam (204) created beautifully and precisely along the curved or wavy end thereof, as in FIG. 9.

If it is desired to sew the curved end (200) of trim cover assembly (F) with the end of other separate cloth or cover material, a suitable mounting member should be provided upon the table (8) and located under the above-described guide device, although now shown. In this case, the mounting member be so constructed as to secure that other cloth or cover material thereon for sewing with the trim cover assembly (F), as suggested from the Japanese Patent Application No. 60-118565 filed by the same assignee of the present invention.

Figure 6:
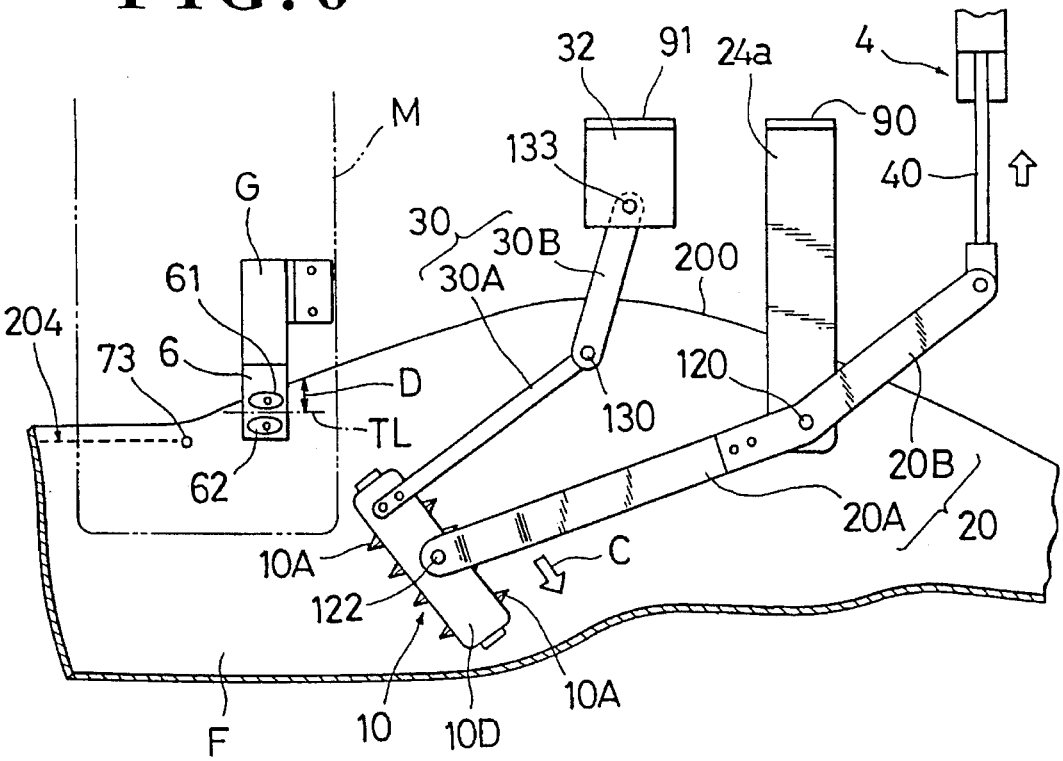
FIG. 6 is a partly broken, schematic plan view of the guiding device, showing the motion of a guide roller assembly.

Referring to FIG. 6, where the trim cover assembly end (200) happens to be greatly dislocated by such amount (D) from a reference line set by the sensor (6), the control drive mechanism (4), upon receiving a corresponding detection signal from the photosensors (61)(62), will cause an additional further rotation of both arm (20) and roller assembly (10, 11) at a certain rotation angle compensating for the dislocation amount (D), as indicated by the arrow (C), to thereby maintain a stable sewing along the curved end (200) of trim cover assembly (F).

From the descriptions above, the present invention is endowed with the following remarkable advantages:

(i) The trim cover assembly (F) is only retained by the sewing machine (M) and guide roller assembly (10, 11), and further controlled for sewing its curved end (200) by the simple controlled rotation of guide roller assembly (10, 11) on the horizontal plane above and below the trim cover assembly (F). This only requires the above-discussed tangential orientation of the curved or wavy trim cover assembly end (200), at one point, in parallel with the sewing direction of the sewing machine (M). Thus, there is eliminated such complicated structure and sewing control mechanism as found in the prior art.

(ii) In addition, the guide roller assembly (10, 11) is restricted its movability by means of the link assembly (30, 31), so that the guide roller assembly per se is rotated along a required track without undesired wobbling and unnecessary rotation. This adds to a high precision in guiding the trim cover assembly (F) to the sewing machine (M).

While having described the present invention thus far, it should be understood that the invention is not limited to the illustrated embodiment, but any other modifications, replacements and additions may be applied structurally thereto without departing from the scopes of appended claims.

What is claimed is:

1. A device for guiding a cover member to a sewing machine, comprising:

a pair of upper and lower guide roller means for retaining said cover member therebetween, while allowing the same to be fed toward a sewing machine;

a pair of upper and lower control arm means, each having one end connected operatively with said pair of upper and lower guide roller means and another end connected operatively with a control drive mechanism;

said pair of upper and lower control arm means being pivotally rotatable so that said one end thereof may be rotated, through operation of said control drive mechanism, relative to a pivot point, to thereby cause rotative displacement of said upper and lower guide roller means in reference to a direction in which said cover member is sewn; and a link means including a first link element having one end operatively fixed to said pair of upper and lower guide roller means and a second link element having one base end portion adapted to be pivotally supported relative to a sewing machine and another free end portion connected pivotally to another end of said first link element, said pair of upper and lower control arm means and said link means cooperating with each other to allow said rotative displacement of said upper and lower roller means to be effected through the operation of said control drive mechanism, whereby said cover member is guided by said upper and lower roller means.

2. The device as defined in claim 1, wherein said control drive mechanism includes a sensor means adapted to be disposed in proximity of a sewing machine and interposed between said pair of upper and lower guide roller means and a sewing portion of a sewing machine, wherein said sensor means detects a dislocation of said cover member from a reference line set by said sensor , and wherein, responsive to such detection of said sensor, said control drive mechanism causes said rotative displacement of said upper and lower guide roller means so as to correct a position of said cover member whereby said cover member may be precisely sewn along a predetermined sewing path in said direction by said sewing machine.

3. The device as defined in claim 2, wherein said sensor means is provided on a support means which is so formed as to allow said cover member to be pass therethrough.

4. The device as defined in claim 2, wherein said sensor means is so arranged as to detect one end of said cover member and a dislocation of the same.

5. The device as defined in claim 4, wherein said sensor means comprises a pair of spaced-apart photosensors for detecting therebetween said one end of said cover member in order to detect a dislocation of said one end of said cover member.

6. The device as defined in claim 1, wherein said upper guide roller means are movable vertically toward and from said lower guide roller means, wherein said upper guide roller means comprises a plurality of disc-like rollers and said lower guide roller means comprises a cylindrical roller having a plurality of annular grooves formed on the periphery thereof in correspondence with the respective said disc-like rollers, and wherein downward movement of said upper guide roller means brings said disc-like rollers into a meshed engagement with the said respective annular grooves of said cylindrical roller , so that said cover member may be retained between and by said disc-like rollers and cylindrical roller.

7. The device as defined in claim 6, wherein said upper guide roller means are moved vertically by a hydraulic cylinder toward and from said lower guide roller means.

8. The device as defined in claim 1, wherein said upper and lower control arm means are adapted to be pivotally supported, generally at the center thereof, by a support means upon a table of a sewing machine.

9. The device as defined in claim 1, wherein said pair of upper and lower guide roller means are connected rotatably to said one end of said pair of upper and lower control arm means, wherein said upper and lower control arm means are adapted to be pivotally supported, generally at the center thereof, by a support means upon a table of a sewing machine, wherein said control drive mechanism includes a sensor means which is adapted to be so disposed in proximity of a sewing machine as to detect one curved end of said cover member and a dislocation of the same from a reference line set by said sensor, wherein said base end portion of said second link element is pivotally supported by a support means disposed between said sensor means and the support means of said upper and lower control arm means, and wherein, responsive to such detection of said sensor means, said control drive mechanism causes said upper and lower control arm means to be rotated generally about the center thereof, thereby causing said upper and lower guide roller means to be displaced rotatively relative to said center together with said first and second link elements, so as to correct a position of said cover member whereby said cover member is precisely sewn along said curved end of said cover member.

10. The device as defined in claim 9, wherein said reference line is a tangential line touching on a curvature in said curved end of said cover member, and wherein responsive to said sensor means detecting dislocation of said cover member from the reference line, said control drive mechanism causes said upper and lower guide rollers to be displaced rotatively relative to said center, so as to orient said cover member such that said tangential line touching on the curvature in the curved end of said cover member is kept in parallel relation with said direction wherein said cover member is sewn by said sewing machine.

11. The device as defined in claim 1, wherein said control drive mechanism further includes a driving wheel, an endless belt engaged over said driving wheel and an actuator rod fixed on said endless belt, wherein said actuator rod is operatively connected to said another end of said upper and lower control arm means.

12. The device as defined in claim 1, which further comprises a base plate on which said trim cover assembly is placed, said base plate being adapted to be disposed on the table of said sewing machine such as to extend between said pair of upper and lower control arm means, and having a generally curved end portion for avoiding interference with said rotative displacement of said pair of upper and lower guide roller means.

13. The device as defined in claim 1, wherein said cover member is a three-layer-lamination-type trim cover assembly which comprises a top cover member, a foam wadding and a wadding cover.

14. The device as defined in claim 9, wherein said cover member is a three-layer-lamination-type trim cover assembly having one curved end portion, which comprises a top cover member, a foam wadding and a wadding cover.

15. In combination with a sewing machine, a device for guiding a cover member to said sewing machine, comprising:

a pair of upper and lower guide roller means for retaining said cover member therebetween, while allowing the same to be fed toward said sewing machine, said pair of upper and lower guide roller means being disposed in the vicinity of a sewing portion of said sewing machine;

a pair of upper and lower control arm means, each having one end connected operatively with said pair of upper and lower guide roller means and another end connected operatively with a control drive mechanism;

said pair of upper and lower control arm means being pivotally rotatable so that said one end thereof may be rotated, through operation of said control drive mechanism, relative to a pivot point, to thereby cause rotative displacement of said upper and lower guide roller means in reference to a direction in which said cover member is sewn by said sewing machine; and a link means including a first link element having one end operatively fixed to said pair of upper and lower guide roller means and a second link element having one base end portion pivotally connected to a table of said sewing machine and another free end portion connected pivotally to another end of said first link element, said pair of upper and lower control arm means and said link means cooperating with each other to allow said rotative displacement of said upper and lower roller means to be effected through the operation of said control drive mechanism, whereby said cover member is guided by said upper and lower roller means and fed towards the sewing portion of said sewing machine.

16. The combination of claim 15, wherein said control drive mechanism includes a sensor means disposed in proximity of said sewing machine and interposed between said pair of upper and lower guide roller means and said sewing portion of said sewing machine, wherein said sensor means detects dislocation of said cover member from a reference line set by said sensor, and wherein, responsive to such detection of said sensor, said control drive mechanism causes said rotative displacement of said upper and lower guide roller means so as to correct a position of said cover member whereby said cover member is precisely sewn along a predetermined sewing path in said direction wherein it is sewn by said sewing machine.

17. The combination of claim 16, wherein said sensor means is provided on a support means which is so formed as to allow said cover member to pass therethrough.

18. The combination of claim 16, wherein said sensor means is so arranged as to detect one end of said cover member and a dislocation of the same.

19. The combination of claim 18, wherein said sensor means comprises a pair of spaced-apart photosensors for detecting therebetween said one end of said cover member in order to detect a dislocation of said one end of said cover member.

20. The combination of claim 15, wherein said upper guide roller means are movable vertically toward and from said lower guide roller means, wherein said upper guide roller means comprises a plurality of disc-like rollers and said lower guide roller means comprises a cylindrical roller having a plurality of annular grooves formed on the periphery thereof in respective correspondence with said disc-like rollers, and wherein downward movement of said upper guide roller means brings said disc-like rollers into a meshed engagement with said respective annular grooves of said cylindrical roller, so that said cover member may be retained between and by said disc-like rollers and cylindrical roller.

* * * * *